US005795389A

United States Patent [19]

Koschitzky

[11] Patent Number: 5,795,389

[45] Date of Patent: Aug. 18, 1998

[54] METHOD AND APPARATUS FOR APPLYING SURFACING MATERIAL TO SHINGLES

[75] Inventor: Henry Koschitzky, Downsview, Canada

[73] Assignee: Iko Industries Ltd., Toronto, Canada

[21] Appl. No.: 602,188

[22] Filed: Feb. 16, 1996

Related U.S. Application Data

[63] Continuation-in-part of Ser. No. 392,319, Feb. 22, 1995, abandoned.

[51] Int. Cl.[6] ..... B05C 7/06; B05C 19/06

[52] U.S. Cl. ..... 118/308; 118/322; 118/324; 118/325; 427/180; 427/186; 427/282

[58] Field of Search ..... 427/180, 186–188, 427/282; 118/324, 325, 322, 308

[56] References Cited

U.S. PATENT DOCUMENTS

| | | | |
|---|---|---|---|
| 2,056,275 | 10/1936 | Holdsworth | 427/188 |
| 2,111,565 | 3/1938 | Limerick | 427/188 |
| 3,138,335 | 6/1964 | Vessels | 118/308 |
| 4,352,837 | 10/1982 | Kopenhaver | 427/187 |
| 4,523,543 | 6/1985 | Brady et al. | 118/697 |
| 4,800,102 | 1/1989 | Takada | 427/197 |
| 4,850,304 | 7/1989 | Nicholson | 118/694 |
| 4,900,589 | 2/1990 | Montgomery | 427/188 |
| 4,984,169 | 1/1991 | Johnson | 364/469 |
| 5,283,080 | 2/1994 | Lamb et al. | 427/8 |
| 5,415,717 | 5/1995 | Permeborn | 156/276 |

FOREIGN PATENT DOCUMENTS

| | | |
|---|---|---|
| 57-53274 | 3/1982 | Japan . |
| 92-00271 | 10/1993 | Sweden . |

*Primary Examiner*—Shrive Beck
*Assistant Examiner*—Fred J. Parker
*Attorney, Agent, or Firm*—Bereskin & Parr

[57] ABSTRACT

A device is provided for placing sharply demarcated patches on roofing products such as shingles or sheeting without the need for a double layer of asphalt. After the base sheet has been covered with a layer of coating asphalt, granules to form the patch are dropped on the base sheet through a hole in a belt which moves parallel to and just above the base sheet. The moving hole in the belt ensures that the patches will have sharp leading and trailing edges. The belt can have several holes for different size patches, and/or different blends of granules can be applied through the same or different holes. After the patches have been applied, the remainder of the sheet is covered with granules. Alternatively, the granules which drop on the spaces on the belt between the belt openings can be applied to the base sheet to form sharp edged patches, while the granules dropping through the holes in the belt can be removed and collected for re-use.

13 Claims, 6 Drawing Sheets

METHOD AND APPARATUS FOR APPLYING SURFACING MATERIAL TO SHINGLES

CONTINUING APPLICATION STATUS

This application is a continuation-in-part of co-pending application Ser. No. 08/392,319 filed Feb. 22, 1995 entitled "METHOD AND APPARATUS FOR APPLYING SURFACING MATERIAL TO SHINGLES".

FIELD OF THE INVENTION

This invention relates to a method and apparatus for applying surfacing material such as mineral granules to shingles and other roofing products. More particularly, it relates to an arrangement for applying relatively sharply demarcated patches to roofing products such as roofing sheets, and shingles, without the need for double layers of asphalt which have been used in the past.

BACKGROUND OF THE INVENTION

Roofing shingles are usually made by taking a continuous base sheet of material (e.g. organic felt, fiberglass mat or the like), saturating the base sheet in a base asphalt, covering it with a coating asphalt, and then embedding a mineral surfacing material such as granules on the top side of the coated sheet. The granules protect the asphalt from breaking down by oxidation caused by ultraviolet rays. The finished sheet is then cut into lanes and then into desired lengths for shingles.

It is common to provide additional decoration for the shingles by providing a set of patches on their exposed (when applied on a roof) surfaces. If sharply demarcated patches are needed, they are normally produced by printing patches of a second layer of asphalt coating on exposed parts of the shingles and then embedding granules in the asphalt patches. The resultant granule patches, which may be of different color from the base layer of granules, add to the variety and attractiveness of the shingle's appearance.

U.S. Pat. No. 4,352,837 (Kopenhaver) and U.S. Pat. No. 5,186,980 (Koschitzky) both disclose methods of applying patches of asphalt and granules as a second layer to a first uniform layer of granules.

Applying second layers of asphalt and granules to the shingle has disadvantages in terms of increased cost. In addition, it can result in decreased flexibility of the shingle, as noted in U.S. Pat. No. 5,347,785 (Terrenzio and Noone). Therefore it would be desirable to apply sharply demarcated patches without the need for applying extra layers of asphalt and granules. Unfortunately this has not easily been possible in the past.

One of the problems has been that the base sheet on which the granules are dropped typically travels at about 500 feet per minute, or more than 8 feet per second. As will be described, granules are normally dispensed in a uniform layer by one or more fluted rolls located at the outlet of a hopper containing the granules. The roll rotates for a desired time for a desired fixed number of degrees. (Gates can alternatively be used to dispense the granules, as shown in the above mentioned Kopenhaver patent.) If the patch for which granules are being dispensed is (for example) six inches long (patches typically range between four and thirty inches long), then since the sheet will travel six inches in less than 1/16 of a second, the granule dispensing must be started, continued, and then stopped all in this very short time interval (about 0.06 seconds).

Because of the short time intervals available, it has been difficult or impossible in the past to start and stop the flow of granules sufficiently quickly to produce sharply demarcated leading and trailing edges for the patch being formed. For example, if it takes 0.01 second to start or stop dispensing, each of these time intervals is about 1/6 the length of the patch. This is unacceptable where sharp demarcations are desired, and for this reason patches have normally been produced by printing a second layer of asphalt on the sheet as described in the above patents (so that granules which do not fall on the sharply demarcated asphalt patch do not stick).

BRIEF SUMMARY OF THE INVENTION

Therefore it is an object of the invention to provide apparatus and method for making a roofing product such as a sheet or shingle having patches or other patterns in which sharp lines of demarcation can be created without the need to utilize additional layers of asphalt.

In one of its aspects the present invention provides an apparatus for depositing a surfacing material on an asphalt coated sheet, for producing roofing, said apparatus comprising:

(a) means for causing said sheet to travel in a first direction, (b) first belt means having upper and lower flights and having an opening therein, (c) means for causing said upper flight of said first belt means to travel above said sheet with a component of movement of said upper flight being in said first direction, (d) surfacing material supply means located above said upper flight for dropping said surfacing material onto said upper flight so that some of said material falls through said opening and some of said surfacing material remains on said upper flight, the surfacing falling through said opening being a first sub-set of said surfacing material and said surfacing material remaining on said upper flight being a second sub-set of said surfacing material, (e) means for applying said second sub-set of surfacing material onto said sheet to form patches thereon;

(f) and means located between said upper flight and said sheet for collecting and removing said first sub-set of surfacing material.

Further objects and advantages of the invention will appear from the following description, taken together with the accompanying drawings.

DETAILED DESCRIPTION OF PREFERRED EMBODIMENTS

Figures 1, 1A:
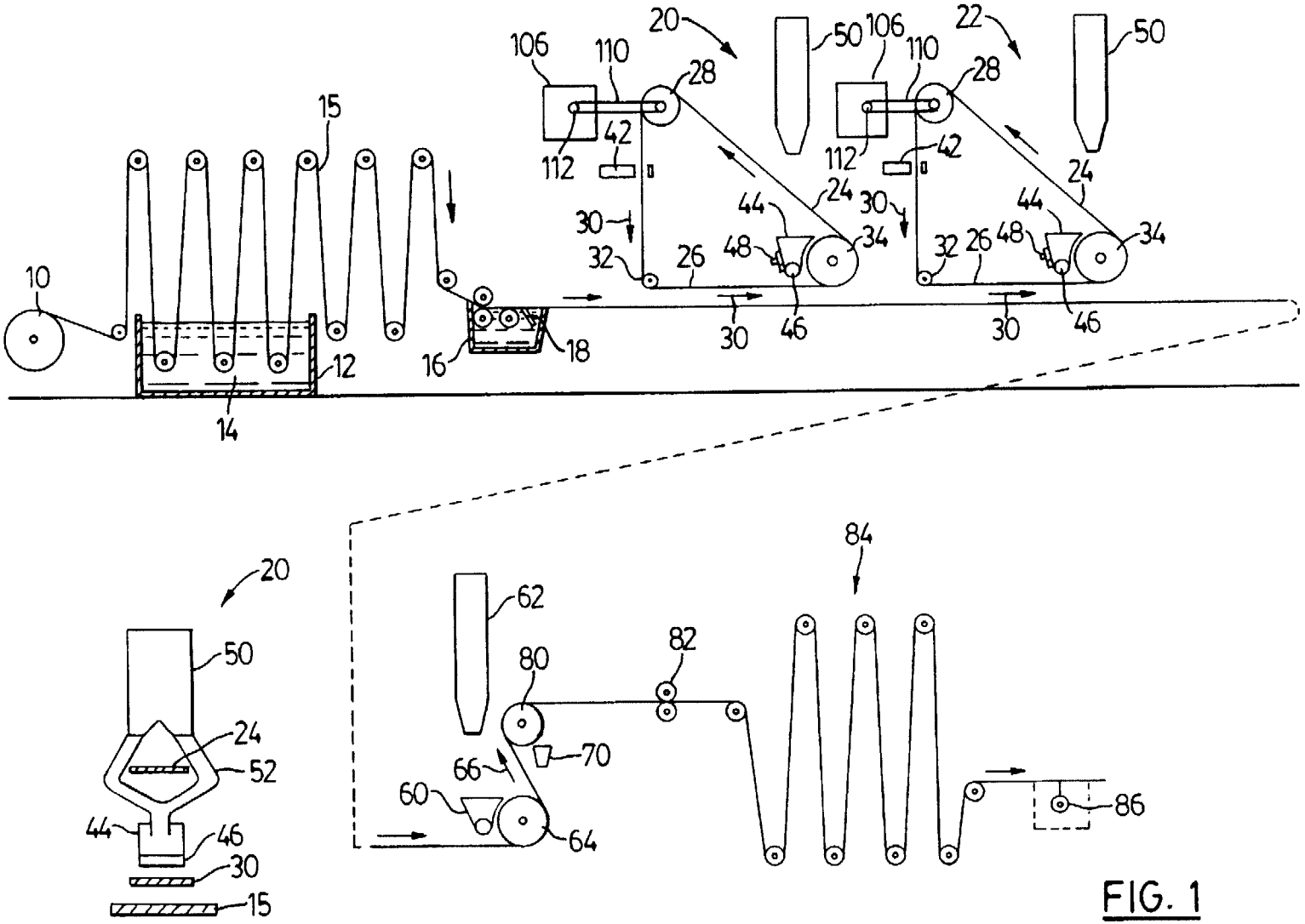
FIG. 1 is a diagrammatic view of a production line for producing roofing shingles according to the invention.
FIG. 1A is a diagrammatic view of part of a patch applicator of FIG. 1.

The production line shown in FIG. 1 is conventional except as will be noted, and its conventional aspects are therefore only briefly described.

As shown, the FIG. 1 production line includes a roll 10 of organic felt or fiberglass mat. The felt is unrolled and dipped several times into a saturator tank 12 which contains a conventional saturant asphalt 14 at an elevated temperature such as about 450° F. If a fiberglass mat is used, the mat typically passes over the saturator tank 12 and does not come in contact with the saturant 14. The sheet, indicated at 15, is then passed through a coating tank 16 where it is covered (top and bottom) with a coating asphalt at an elevated temperature such as about 400° F. The coating asphalt is usually mixed with a filler.

The coating asphalt helps to provide the shingle with its water proofing properties. A scraper 18 may be used to remove the excess coating asphalt from the back of sheet 15. The excess is returned to tank 16.

In the past, the asphalt coated sheet 15 was normally covered with a mineral surfacing such as granules. Asphalt patches were then printed on the continuous granule covered surface and granules of a contrasting color (to produce the patches) were dropped and would adhere to the asphalt patches.

According to the invention, the granule patches are applied first to the asphalt coated sheet. The remainder of the exposed asphalt coating on the sheet is covered with other granules after the granule patches have been applied.

In one embodiment of the invention granule patches are applied using one or more of the patch applicators shown at 20, 22 in FIG. 1. Both patch applicators 20, 22 are identical except for the number and sizes of holes in the belts (to be described), and the same reference numerals are used to indicate corresponding parts in them.

The patch applicator 20 includes an endless belt 24 arranged (for example) to run in a triangular configuration as shown, with its lower flight 26 extending parallel to and a short distance (e.g. several inches) above the sheet 15. The belt 24 is driven by a drive roll 28 (by means to be described) so that its lower flight 26 travels in the same direction as sheet 15, as indicated by arrows 30. The belt 24 also travels around an idler roller 32 and a slate drum 34. (The belt 24 can alternatively be run in a rectangular or other configuration, around four or five rollers, as desired).

Figure 2:
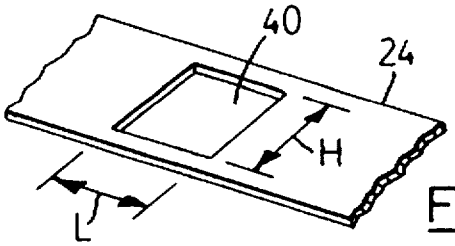
FIG. 2 is a perspective view of a belt from the FIG. 1 apparatus and showing an opening therein.

The belt 24 contains a rectangular opening 40 (FIG. 2) of length L correlated to the length (as measured in the direction of travel of the sheet 15) of the patch to be applied, and of height H equal to the height of the patch to be applied on the sheet 15.

A detector 42 (which can be an optical detector, a capacitive detector or any other desired type) is positioned over the belt 24 and detects when the leading edge of opening 40 passes by. The detector signal is used to make adjustments to the phase of the belt as will be described.

A hopper 44 is positioned over the belt, adjacent the drum 34, and feeds a desired blend of granules onto the upper surface of the flight 26 of the belt. The hopper 44 is of conventional construction, having a roll 46 which has a fluted or roughened outer surface (not shown) located in its lower opening. As is well known, when the roll 46 rotates, its fluted or roughened surface drags a layer of granules with it and thus causes a curtain or veil of granules to spill out over the width of the roll 46. A conventional gate 48 can be adjusted upwardly or downwardly to control the thickness of the layer of granules which the roll 46 dispenses.

The hopper 44 is kept supplied with granules from a bin 50 which is positioned above the hopper 44. Granules from the bin 50 are supplied via a Y-shaped chute 52 (FIG. 1A). One leg of the chute 52 passes on each side of the upper flight of belt 24, to the hopper 44.

Figure 3:
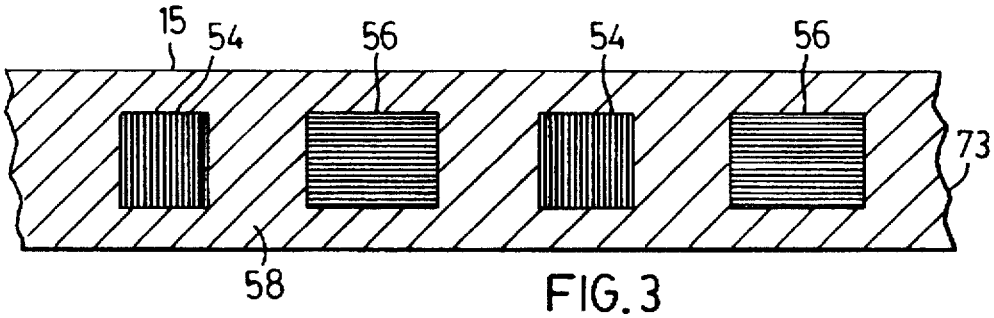
FIG. 3 is a top plan view of a portion of two lanes of partly formed shingles according to the invention, coated with asphalt and with patches of granules applied.

In the embodiment shown in FIG. 1, granules are dispensed continuously from hopper 44 onto the belt 24. When the opening 40 is not under hopper 44, the granules normally fall onto the upper surface of the flight 26 of the belt, are carried around the drum 34, and as shown are then returned by the drum 34 into the hopper 44. However when the opening 40 in the belt travels beneath the hopper 44, the granules then fall through the opening 44 onto the sheet 15, forming a first set of patches 54 as shown in FIG. 3. The second granule applicator 22 (which may be supplied with a differently colored blend of granules) applies a second set of patches 56. Because the granules fall continuously, without the need to start or stop the flow, and because the start of granule application, and the granule cut-off, provided by the moving opening 40 is sharp, each patch has a sharply demarcated leading and trailing edge. The remainder of the exposed surface of sheet 15 remains at this time coated with tacky asphalt 58.

If the belt 24 travels at the same speed as the sheet 15, then the length L of the opening 40 will be the same length as that desired for the patch which is to be applied. For example if a six inch patch is to be applied, then length L would be six inches. However, it will commonly be more convenient to have the belt 24 travelling at a lower speed than that of sheet 15. For example belt 24 may travel at 250 feet per minute (as compared with 500 feet per minute for sheet 15, by way of example). If belt 24 travels at half the speed of sheet 15, then for a six inch patch length L would be three inches, since while the belt travels through a distance of three inches, the sheet 15 will travel six inches, producing a six inch patch.

In general the relationship is:

$$\text{length of opening} = \text{length of desired patch} \times \frac{\text{beltspeed}}{\text{sheetspeed}}$$

After the patches 54, 56 have been applied, the entire sheet 15 is then covered with granules from a cover-up or spill hopper 60, supplied from bin 61 in conventional manner. Cover-up hopper 60 covers the entire exposed surface of sheet 15 with granules, as shown at 62 in FIG. 4. The sheet 15 then travels around slate drum 64 and travels along an inverted path 66, at which time granules which have not adhered to the asphalt 58 can fall back into hopper 60. These granules are delivered back to the exposed surface of sheet 15. As the sheet 15 follows the inverted path 66, a coating of fine mineral surfacing, such as 50 mesh dolomite or talc, is added to the back of the sheet from hopper 70 (from a supply not shown), to help prevent the sheet from sticking to the rolls or while in bundles.

Figure 4:
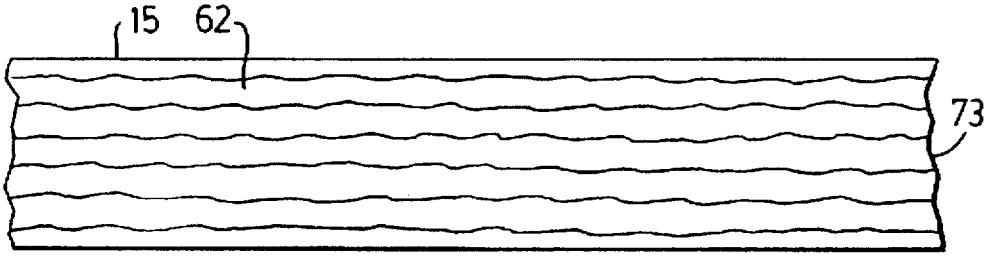
FIG. 4 is a top plan view of the lanes of FIG. 3 with granules applied over their entire surface.
Figure 5:
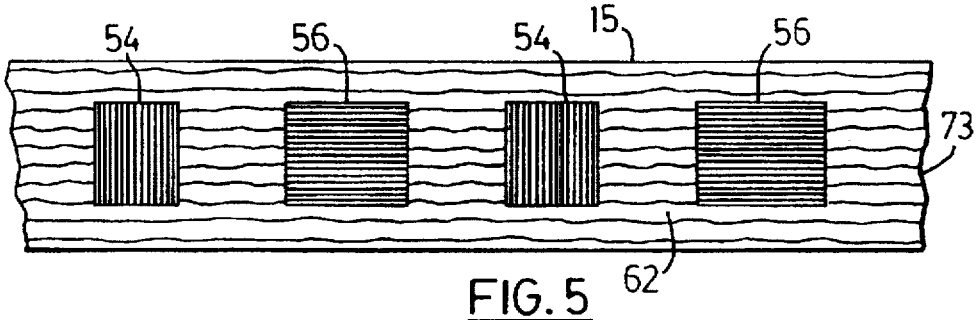
FIG. 5 is a top plan view of the lanes of FIG. 3 with excess granules removed, showing the lanes finished and ready for cutting.

The exposed surface of the sheet 15 now has the appearance shown in FIG. 5, where the entire sheet other than the patches is covered with background colored granules 62. (FIGS. 4 and 5 show one pair of lanes 73.) The granules 62 have adhered to the sheet wherever there is exposed asphalt, but do not of course adhere over the patches 54, 56 since the asphalt under the patches has previously been covered with the granules of the patches.

Figure 6:
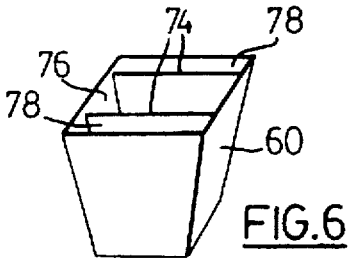
FIG. 6 is a perspective view of a hopper used to apply granules.

If desired, dividers 74 (FIG. 6) can be placed in the hopper 60, extending longitudinally in the direction of travel of the sheet 15. As is conventional, the space 76 between the dividers can be supplied with granules of a color desired for the exposed surface of the shingles when the shingles are on the roof, while the headlap portions of the shingles (which will be covered by an adjacent shingle) can be covered with uncolored granules supplied to spaces 78 at the sides of the hopper 60. This reduces cost since colored granules are much more expensive than uncolored granules.

After passing drum 64 and back surfacing roll 80, the sheet 15 then passes through press rolls 82 which better embed the granules and mineral particles which have been deposited on it. The sheet 15 then passes through a cooling section and product looper 84, where it accumulates and is allowed to cool, using air fans (not shown). The sheet 15 then enters a cutting section which, using a cutting cylinder 86 that has both lengthwise and crosscut knives, cuts the sheets into lanes and into individual shingle widths, and to desired lengths.

Figure 7:
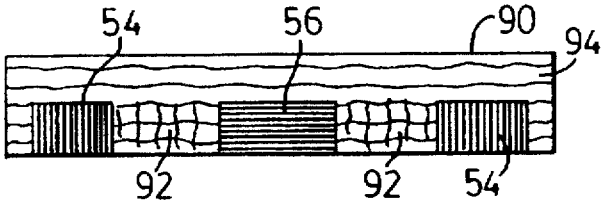
FIG. 7 is a top plan view of a finished shingle produced from the FIG. 5 lanes.

FIG. 7 shows a finished shingle 90 which has been made from a lane such as lane 73 of FIG. 5, by cutting the lane in half lengthwise. The shingle 90 has the two sets of patches 54, 56 described on its exposed surface. The areas in between the patches are covered with blended and normally colored granules 92, while the headlap portion of the shingle may be covered with uncolored granules 94.

Figure 8:
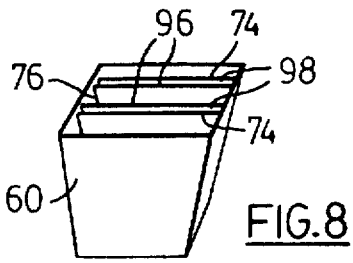
FIG. 8 is a perspective view of a modified hopper for applying granules.
Figure 9:
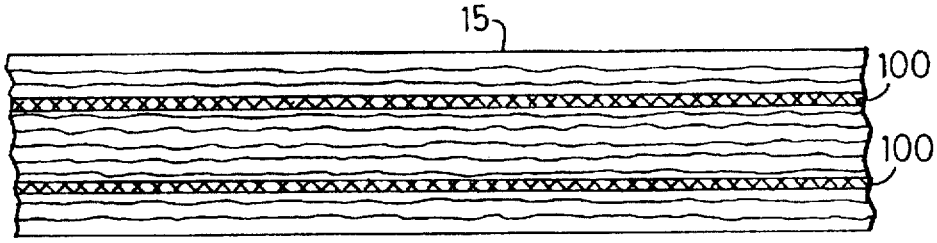
FIG. 9 is a top plan view of lanes such as those of FIG. 3, with cover-up granules applied using the hopper of FIG. 8.
Figure 10:
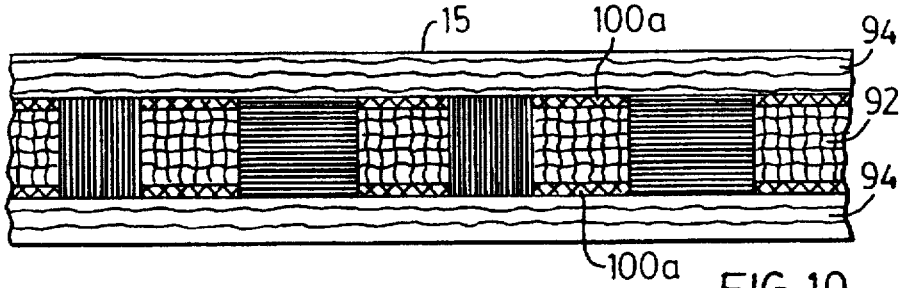
FIG. 10 is a top plan view of the FIG. 9 lanes with excess granules removed.

If desired, additional dividers can be placed in the hopper 60 as shown at 96 in FIG. 8. The dividers 96 are located within the space 76 between the dividers 74, and are located close to the dividers 74 to form narrow spaces or bands 98 between them. The spaces 98 are filled, as is conventional, with dark colored granules which when dropped form shadow bands or dark lines 100 (FIG. 9) on the exposed surface of the sheet 15. After the sheet 15 passes around drum 64, the dark colored granules are removed except in the spaces between the patches 54, 56, thus forming shadow bands 100*a* (FIG. 10) between the patches. This will provide a more three-dimensional effect for the shingle when it is on a roof. Alternatively, and as is also conventional, dividers can be placed in the hoppers 44 of FIG. 1 to produce the shadow bands as part of the patches themselves. (Shadow bands are conventional and are shown for example in the U.S. design patent Des. No. 309,027 to Noone et al).

While a single opening 40 has been shown in belt 24, if desired two or more openings can be provided in the belt, of different sizes if desired, so that a single patch applicator 20 can be used to apply more than one patch size. In such an arrangement all of the patches will have the same blend or color of granules in them. (While the color of the granule blend supplied from bin 50 can be changed, the variation over time is relatively slow.)

Figure 11:
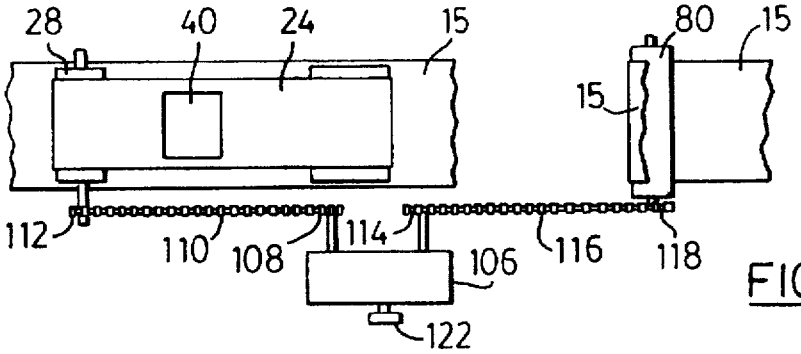
FIG. 11 is a diagrammatic view showing speed control apparatus for controlling the speed of the FIG. 2 belt.

With the arrangement shown, the speed of belt 24 should be synchronized with that of sheet 15. This may be accomplished by driving the belt drive roll 28 through a standard variable chain drive differential 106 sold under the trade mark SPEECON by Fairchild Industrial Products Company of Winston, Salem, N.C. As shown in FIG. 11, one sprocket 108 of differential 106 is connected via chain 110 to a sprocket 112 which in turn is mounted on the shaft of belt drive roll 28. The other sprocket 114 of differential 106 is connected via chain 116 to a sprocket 118. Sprocket 118 is mounted on the shaft of the back surfacing rolls 80 (this roll is used because there is little or no slippage between it and sheet 15). If the belt 24 slips on its rolls, a phase controller input 122 can be used to rotate one side of the differential 106 to add or subtract part of a revolution from the output sprocket 108, until the proper position or phase of the opening 40 in the belt 24, relative to the patch pattern desired has been achieved. Alternatively, timing marks can be placed on the belt 24 and on its drive roll 28 to generate pulses, and a computerized controller can be used to adjust the belt position as needed, by taking a reference from timing marks on the surfacing roll drive.

Figure 12:
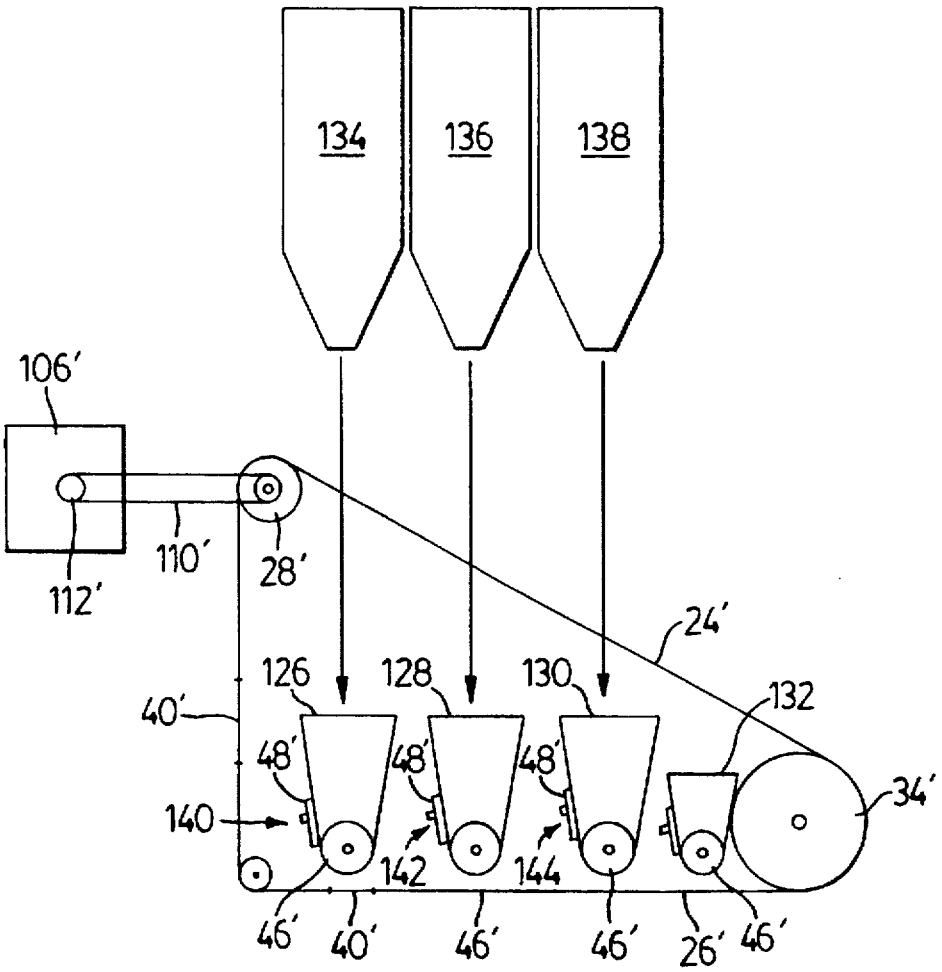
FIG. 12 is a diagrammatic view showing a modified granule applicator for the FIG. 1 production line.

Reference is next made to FIG. 12, which shows another embodiment of a patch applicator 20'. In the FIG. 12 version primed reference numerals indicate parts corresponding to those of FIGS. 1 to 10.

In the FIG. 12 version, four hoppers 126, 128, 130, 132 are located over the lower flight 26' of a single belt 24'. Three of the hoppers are supplied each with a different color blend of granules from bins 134, 136, 138. The belt 24' may contain one or more openings 40', depending on whether several different sizes of patches are desired.

Since more than one hopper is used in FIG. 12, the hoppers should not be permitted to dispense granules continuously. Therefore a standard blender assembly 140, 142, 144 is used with each of the hoppers 126, 128, 130, with a conventional start/stop program, except as will be described. Each blender assembly 140, 142, 144 includes , as previously described, a fluted roll 46' which, when it rotates, drags with it and dispenses a layer of granules (the thickness of the layer being determined by gate 48'). Each fluted roll 46' is, as is conventional, driven through a clutch 150 (FIG. 13) by a continuously turning motor 152. When the clutch is actuated by clutch actuator 154, the clutch 150 engages and turns the roll 46'.

The clutch operation is controlled by a computerized controller 156. Controller 156 receives and counts pulses from a pulse generator 158, which generates pulses dependent on the speed of the sheet 15 (or belt 24 since the two speeds are in fixed relation to each other). Pulse generator 158 produces pulses based e.g. on data (pulses) received from a pulse sensor 160 connected to back surfacing rolls 80'. (As will be evident, one of the timing marks used to produce pulses will provide a reference position for the belt 24).

If, for example, the length of a desired pattern of patches is 1000 pulses long (representing e.g. 100 inches), and if a patch is to be 6 inches long beginning 4 inches into the pattern, then the controller 156 would normally count 40 pulses, then actuate the clutch actuator 154 for the next 60 pulses (dispensing granules), and then deenergize clutch actuator 154. (This method of clutch actuation is conventional).

Figure 14:
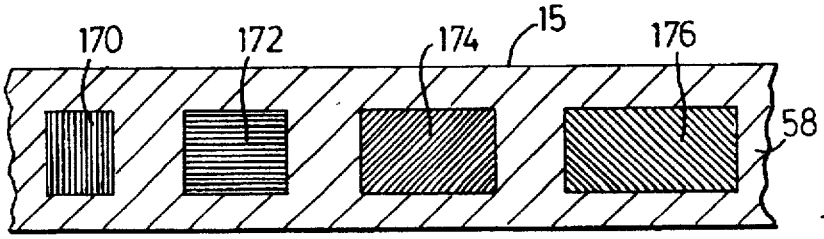
FIG. 14 is a top plan view of a portion of two lanes of partly formed shingles produced from the FIG. 12 apparatus.
Figure 13:
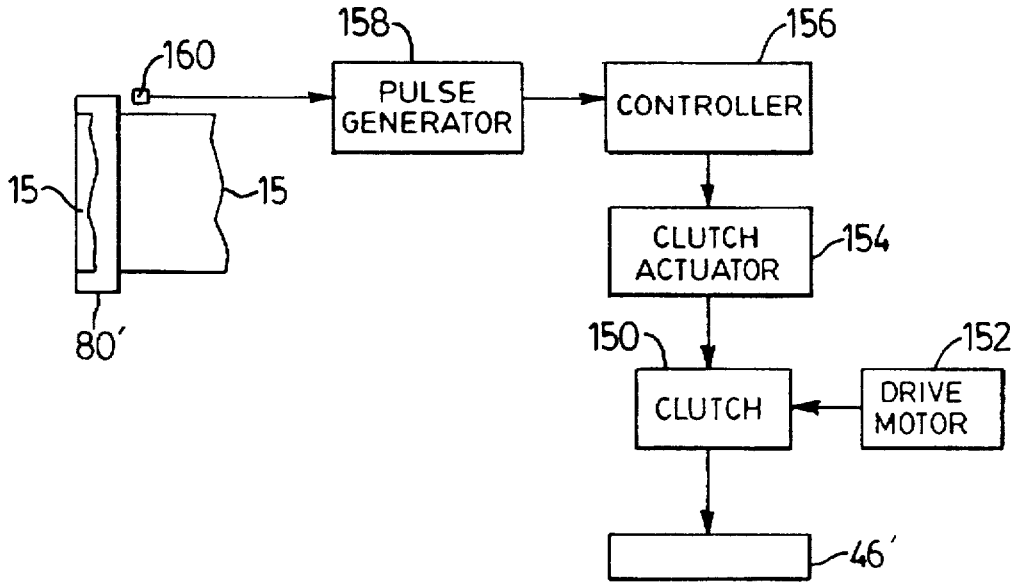
FIG. 13 is a block diagram of control apparatus for the FIG. 12 granule applicator.

However, in the preferred operation of the FIGS. 13 and 14 embodiment, for each hopper its fluted roll 46' will begin rotating a fraction of a second before the opening 46' in the belt begins to appear under the hopper, and will stop a fraction of a second after the opening 46' passes out from under the hopper. For example, instead of actuating clutch 150 at the count of 40 pulses and deactuating it at 100 pulses, the clutch is for example actuated at 34 pulses (6 pulses or 0.6 inches early) and is deactuated at 106 pulses (6 pulses or 0.6 inches late). The intermittent operation of rolls 46' will prevent granules from falling through the wrong opening (if more than one opening is used in the belt), and will also eliminate excess granules on the belt which would then have to be used up elsewhere on the sheet. The reason for the early actuation and late deactivation of the clutches 150 is as follows.

Because the fluted rolls 46' cannot begin, nor stop, dispensing granules instantaneously, if the clutch 150 were to engage just when the leading edge of opening 40' passed below the roll of that clutch, and if the clutch were to disengage just when the trailing edge of opening 40' passed out from under the roll, there would be a risk of creating poorly defined leading and trailing edges in the patch being created. While the risk may be minor (since the patch leading edge tends to be reasonably sharply defined and since any normal delay in stopping the dispensing will be dealt with by the fact that the belt opening 40' will have passed out from under the hopper in question), it is preferred as a precaution to start dispensing granules slightly early and to stop slightly late.

Typically the length of each drop will be about 10% to 20% longer than the patch needed. Thus, if a 6 inch patch is needed, typically a 6.6 to 7.2 inch patch may be dropped on the belt. In this way the drop is fully operational when the opening first appears beneath the hopper and continues to be fully operational when the opening moves out from under the hopper. If there are three drops from three hoppers 126, 128, 130, and each drops 10% to 20% excess granules, this means that 30% to 60% excess granules have been deposited on the belt. These excess granules are then injected into the fourth or excess hopper 132, via slate drum 34'.

Since each hopper 126, 128, 130 supplies granules of a different color or blend of colors, the granules delivered by drum 34' into the excess hopper 132 will be a mixture of these colors. The mixture can be removed by a screw under hopper 132 and delivered to the cover-up hopper 60 for use in covering the remainder of the sheet. However preferably, and as shown in FIG. 12, the mixture in excess hopper 132 is dispensed to form all or part of a fourth set of patches on the sheet 15. Any excess granules needed for this purpose can be supplied by a bin (not shown) located above hopper 132, or alternatively they can be supplied from the cover-up hopper 60 when the remainder of the sheet 15 is covered (in which case the granules for the fourth set of patches will be a blend of granules from the first three sets and granules from the cover-up hopper 60). The fluted roll 46' for excess hopper 132 is also clutch driven, as described. The colors of the granule blend for this fourth set of patches can be made different from the blend used in cover-up hopper 60 (if the blend used in cover-up hopper 60 is a uniform mixture of the granules used in hoppers 126, 128, 130) by causing one of the hoppers 126, 128, 130 to spill more granules onto the belt 24' than do the other hoppers.

As another alternative, the mixture in excess hopper 132 can be dropped onto one or more of the spaces between the granule patches being applied. (If shadow bands are desired, the areas where the shadow bands are to be placed would be left uncovered by excess hopper 132.)

As in the previous embodiment, shadow bands if desired can be applied using the cover-up hopper 60, or can be applied using one or more of the hoppers 126, 128, 130 or 132.

The length of the belt 24 will normally always be either the length of the cycle of patch pattern desired, or a multiple of the pattern. Since the belt will normally be geared to the machine drive, the belt speed will change with the sheet speed, so that the two will remain synchronized (subject to slippage of the belt, which is adjusted as previously described).

FIG. 14 shows a partly finished lane of sheet 15 having four sets of patches 170, 172, 174, 176, with tacky asphalt 58 on the remainder of the lane. If for example the patches are of lengths four inches, six inches, eight inches and ten inches, each separated e.g. by six inch spaces, then openings 40' in the belt 24' would be provided of lengths two inches, three inches, four inches and five inches, assuming that the belt 24' runs at one-half the sheet speed. The openings would be separated by three inch spaces.

Figure 15:
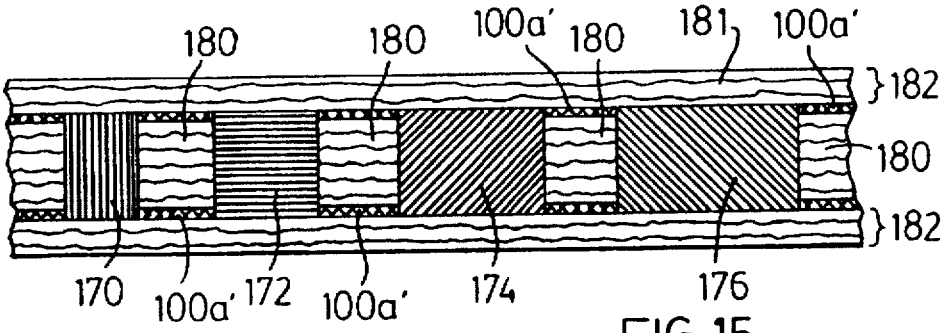
FIG. 15 is a top plan view of the lanes of FIG. 14 with the remainder of the required granule added.

FIG. 15 shows the lane of FIG. 14, completed by having background granules 180, 181 spilled on the sheet and then removed except for the spaces between the patches 170, 172, 174, 176, and the headlap areas 182, where granules 180, 181 stick to the asphalt 58. FIG. 15 also shows shadow bands 100*a*' applied to the spaces between the patches by the cover-up hopper 60, as previously described.

While the opening 40 in belt 24 has been shown as rectangular, it can be any desired shape, depending on the shape of the granule pattern which it is desired to apply to the shingles.

In addition, while the lower flight 30 of belt 24 has been shown as running parallel to sheet 15, it can run at an angle, which will shorten the length of the granule patch applied. The flight 30 of the belt will still of course have a component of movement in the direction of travel of the sheet 15. In fact the length of the granule patch applied through the belt can be adjusted by adjusting e.g. the vertical position of idler roller 32 to adjust the slope of flight 30 of the belt.

Figure 16:
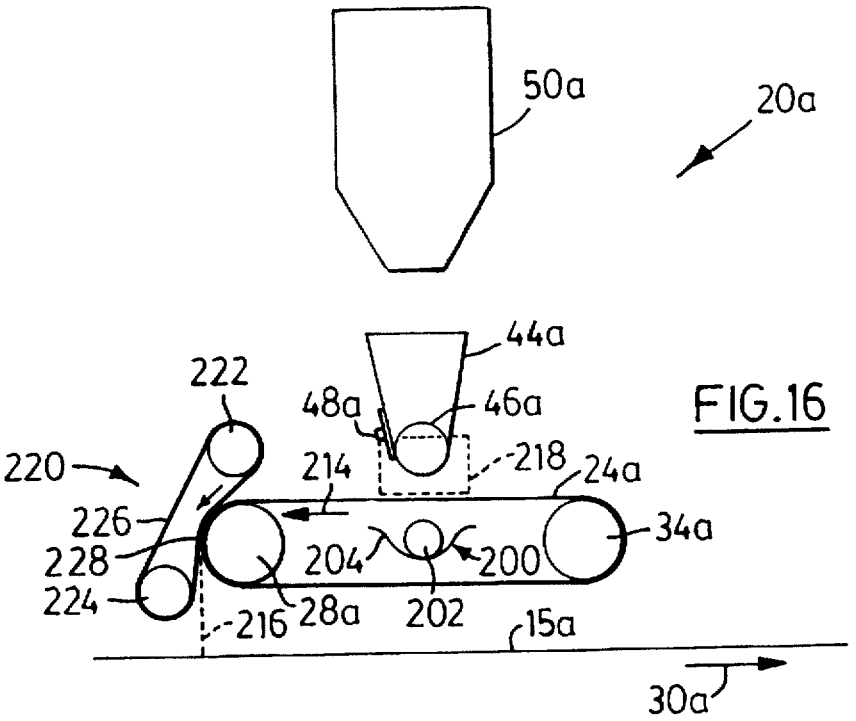
FIG. 16 is a diagrammatic view of a further modified granule applicator for the FIG. 1 production line.
Figure 17:
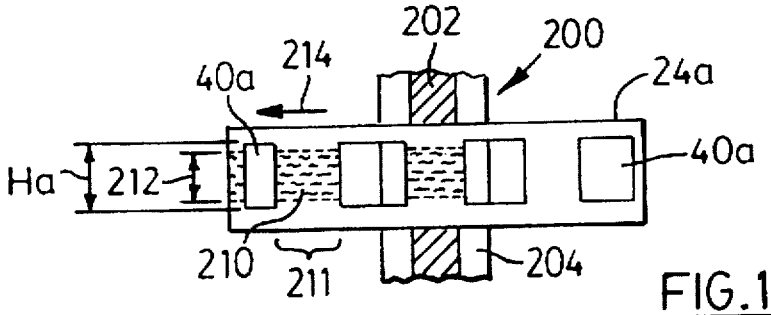
FIG. 17 is a plan view of a conveyor of the FIG. 16 granule applicator.
Figure 18:
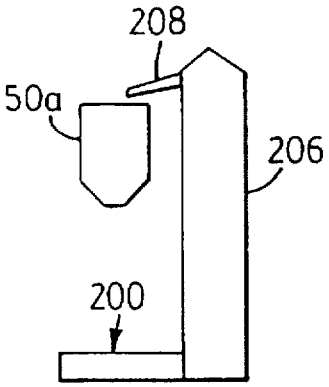
FIG. 18 is a diagrammatic view of an elevator portion of the granule applicator of FIG. 16.

Reference is next made to FIGS. 16 to 18, which show another embodiment of a patch applicator. In the FIGS. 16 to 18 version, reference numerals with the suffix "a" indicate parts corresponding to those of FIGS. 1 to 12.

The FIGS. 16 to 18 version makes a set of patches all of one color and provides another method of forming patches. The patch applicator 20*a* of FIGS. 16 to 18 is in the same location as patch applicator 20 of FIG. 1.

In the FIGS. 16 to 18 version, the belt 24*a* (which has a lower flight 26*a* and an upper flight 26*a*-1) has openings 40*a* as before, but now, granules which are not to be deposited on the sheet 15*a* fall through the openings 40*a* and are carried away by a screw conveyor generally indicated at 200. The screw conveyor 200, which has a screw 202 in a trough 204, removes the granules which fall through the openings 40*a* and returns them to the supply bin 50*a* via elevator 206 and chute 208 so that they can be re-used.

The granules which remain on the upper flight of belt 24*a* are indicated at 210 and are located in spaces 211 between the openings 40*a*. The height 212 of the patches formed by granules 210 is preferably made slightly less than the height Ha of the openings 40*a*. The granules 210 are carried by belt 24*a* to one end of the belt, as indicated by arrow 214, and are then ejected downwardly in a thin veil or curtain 216, onto sheet 15*a*. A pair of vertical side plates, one on each side of hopper 44*a* (one such side plate is shown in dotted lines at 218 in FIG. 16) constrain the granules against falling in a widened pattern as they drop from hopper 44*a*.

To ensure that the granules 210 are ejected downwardly in a thin curtain 216 and are not simply sprayed by belt 24*a*, the granules are retained on belt 24*a*, as they pass around end roller 28*a*, by a hold-down conveyor 220. Conveyor 220 has end rolls 222, 224 and a belt 226 which is driven (by means not shown) in synchronism with belt 40*a*, so that the two belts move at exactly the same linear speed. As shown in FIG. 16, the belt 226 wraps partly around the belt 24*a* at the location where belt 24*a* wraps around end roll 28*a*. The granules 210 are thus held on the belt 24*a* as they are carried around the end turn of belt 24*a* and are re-oriented from horizontal travel to vertically downward travel. Once the granules pass the midpoint 228 of the end roller 28*a* and are travelling vertically, the belt 226 begins to become spaced away from the end roller 28*a*, allowing the granules to be ejected vertically as mentioned.

The effect of the FIGS. 16 to 18 version is that granules which fall through the openings 40*a* are not deposited on sheet 15*a* (at least at the location in question) but instead are removed, while granules falling on the spaces 211 between the openings 40*a* are delivered to and deposited on sheet 15*a* as patches. As before, the lengths of the granule patches applied to sheet 15*a*, as compared with the lengths of the spaces between openings 40*a* will depend on the relative speeds of belt 24*a* and sheet 15*a*. For example, and as previously described, if belt 24*a* is operated at half the speed of sheet 15*a*, then the granule patches deposited on sheet 15*a* will be twice as long as the granule patches deposited between the openings 40*a* of belt 24*a*. However, it is found that the sharpest leading and trailing patch demarcation lines are achieved when both the belt 24*a* and sheet 15*a* are operated at the same speed. The reason for this appears to be that when belt 24*a* is operated at a slower speed than sheet 15*a*, any imperfections in the demarcation line on belt 24*a* will be amplified when the granules are transferred to the faster moving sheet 15*a*.

While in the FIGS. 16 to 18 version, the granules have been shown as being ejected at end roller 28*a*, they can equally well be ejected at end roller 34*a*. In addition, while they are shown as being ejected in a vertical direction, they can if desired be ejected at a slight angle to the vertical (which angle can be either upstream or downstream of the vertical), so long as they are ejected in a thin curtain or veil.

While hold-down conveyor 220 is a convenient way of holding the granules on belt 24*a* so that they can be delivered in a thin curtain or veil onto sheet 15*a*, other means can be used. For example, a suitable shroud enclosing the granule delivery end of belt 24*a* can be used. However, the hold-down conveyor 220 has the advantage that it prevents spraying the granules in unwanted directions.

In the FIGS. 16 to 18 version, the belt 24*a* is shown as having a number of openings 40*a* supplied by a single hopper 44*a*, which is in turn supplied by a single bin 50*a*. This will produce patches on the sheet 15*a* which as mentioned are all of the same colour, or which vary gradually in colour as the colour blend of granules fed to hopper 44*a* is varied. If it is desired that each patch be of a substantially different colour from those of its neighbours, then the apparatus of FIGS. 19, 20 may be used, in which reference numerals ending with the suffix "b" indicate parts corresponding to those of the previous embodiments.

Figure 19:
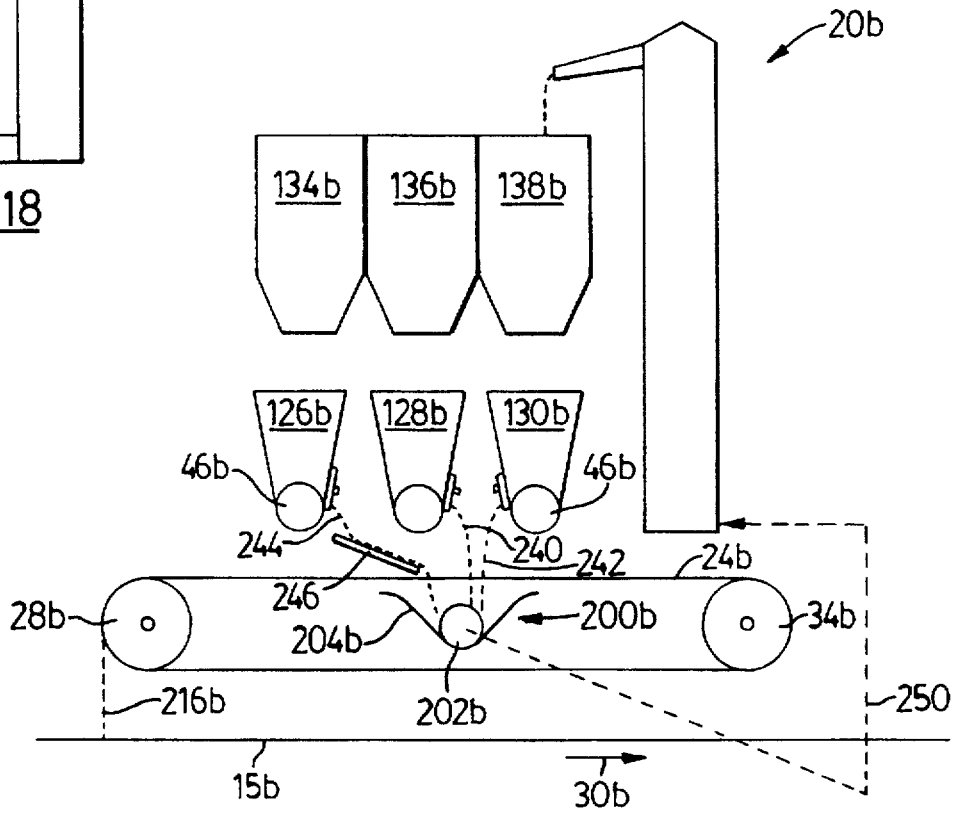
FIG. 19 is a diagrammatic view of a still further modified granule applicator for the FIG. 1 production line.
Figure 20:
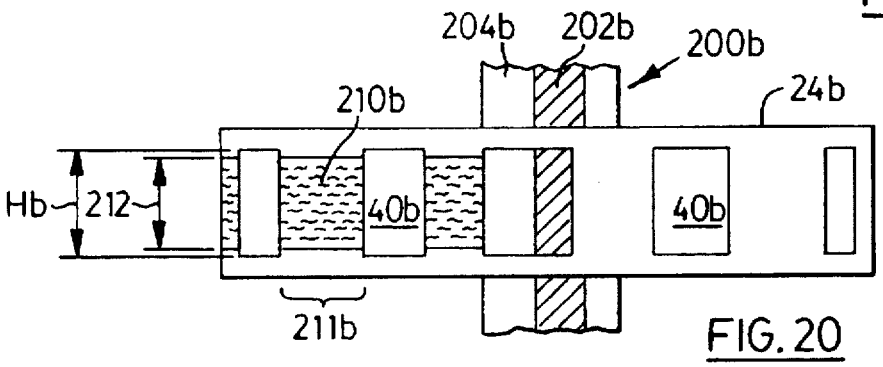
FIG. 20 is a plan view of a conveyor of the FIG. 19 granule applicator.

The FIGS. 19, 20 patch applicator 20*b* is similar to that of FIGS. 16 to 18 and is an analogue of the FIG. 12 version (except that the granules which are to be deposited on sheet 15*b* are those which remain on the belt 24*b*, rather than being those which fall through the openings in the belt 24*b*). The applicator 20*b* is again located in the same position as applicator 20 of FIG. 1.

The belt 24*b* is similar to the belt 24*a* of the FIGS. 16 to 18 version, having a set of openings 40*b* therein separated by spaces 211*b*.

The FIGS. 19, 20 version has (like the FIG. 12 version) three granule dispensing hoppers 126*b*, 128*b*, 130*b*, each with a fluted dispensing roll 46*b* and a gate 48*b*. Each of these hoppers is supplied from a bin 134*b*, 136*b*, 138*b*. For convenience and cost reduction, only one screw conveyor 200*b* is used, which receives unwanted granules from all three hoppers. This is achieved by having the rolls 46*b* of hoppers 128*b*, 130*b* rotate in opposite directions (clockwise and counter-clockwise respectively) so that they discharge their granules (indicated at 240, 242) in approximately the same position, over trough 204*b*. (As is known, when the fluted rolls 46*b* rotate, the granules are dispensed in a curved arc as shown at 240, 242).

The granules dispensed from hopper 126*b* and indicated at 244 are guided by a suitably positioned metal plate 246 so that they also fall into the trough 204*b* and will be collected by the screw conveyor 200*b* when an opening 40*b* appears beneath the lower end of plate 246.

In operation, the flow of granules from hoppers 126*b*, 128*b*, 130*b* is turned on and off as in the FIG. 12 embodiment, so that these hoppers will deposit granules on belt 24*b* in selected spaces 211*b* between openings 40*b*, and not in non-selected spaces 211*b*. Similar to the procedure used in the FIG. 12 embodiment, each hopper 126*b*, 128*b*, 130*b* will begin dispensing shortly before a space 211*b* appears beneath it (i.e. it will begin dispensing over a belt opening 40*b*), and it will cease dispensing shortly after the space 211*b* has travelled beneath it (i.e. it will cease dispensing again over a subsequent belt opening 40*b*). This ensures that the leading and trailing edges of the granule patches will be sharply defined, since the edges of the openings 40*b* define the leading and trailing edges.

Timing of the dispensing from each hopper 126*b*, 128*b*, 130*b* is arranged using the FIG. 13 system. Since there will be a suitable timing mark on the belt 24*b* or on roller 28*b*, the computer controller will know the location of belt 24*b* at all times and will therefore know when to start and stop dispensing from each hopper.

In the embodiment shown in FIGS. 19 and 20, two of the bins 134*b*, 136*b* are each supplied with granules of different desired colours. The granules which fall into screw conveyor 200*b* are carried by the conveyor 200, as indicated by dotted line 250, to elevator 206*b*. Elevator 206*b* and chute 208*b* carry these granules into bin 138*b*, thus creating a third colour blend. Therefore, three different colour patches are achieved with the use of only two pure colour blends.

If shadow bands are desired when the versions of FIGS. 16 to 20 are used, it is preferred to apply the patches first, and then to apply the shadow bands and fill the spaces between the patches with cover-up granules in a suitable pattern.

While the description has focused on shingles, the method and apparatus of the invention can be used for making other roofing products, such as sheet roofing for covering flat or other roofs.

While preferred embodiments of the invention have been described, it will be understood that various changes can be made within the spirit of the invention, and within the concept of dropping the surfacing material onto and through an opening on a moving belt to achieve sharp leading and trailing edges for patches, and after applying the patches, then covering the remainder of the sheet.

I claim:

1. Apparatus for depositing a surfacing material on an asphalt coated sheet, for producing roofing, said apparatus comprising:

(a) means for causing said sheet to travel in a first direction, (b) first belt means having upper and lower flights and having an opening therein, (c) means for causing said upper flight of said first belt means to travel above said sheet with a component of movement of said upper flight being in said first direction, (d) surfacing material supply means located above said upper flight for dropping said surfacing material onto said upper flight so that some of said surfacing material falls through said opening and some of said surfacing material remains on said upper flight, the surfacing material falling through said opening being a first sub-set of said surfacing material and said surfacing material remaining on said upper flight being a second sub-set of said surfacing material, (e) means for applying said second sub-set of surfacing material onto said sheet to form patches thereon, (f) collection means located between said upper flight and said lower flight for collecting and removing said first sub-set of surfacing material and thereby for preventing surfacing material falling from said surfacing material supply means through said opening from falling onto said lower flight;

(g) said means for applying including surfacing material guide means cooperating with said first belt means for directing material from said first belt means onto said sheet, said first belt means including an end turn for connecting said upper flight to said lower flight, said surfacing material guide means comprising second belt means located adjacent said end turn and pressing against said end turn to hold said surfacing material on said first belt means until said surfacing material is moving in a substantially downward direction.

2. Apparatus according to claim 1 and including means for causing said first belt means and said sheet to travel at substantially the same speed.

3. Apparatus for depositing a surfacing material on an asphalt coated sheet, for producing roofing, said apparatus comprising:

(a) means for causing said sheet to travel in a first direction, (b) first belt means having upper and lower flights and having a plurality of openings therein, (c) means for causing said upper flight of said first belt means to travel above said sheet with a component of movement of said upper flight being in said first direction, (d) surfacing material supply means located above said upper flight for dropping said surfacing material onto said upper flight so that some of said surfacing material falls through said opening and some of said surfacing material remains on said upper flight, the surfacing material falling through said opening being a first sub-set of said surfacing material and said surfacing material remaining on said upper flight being a second sub-set of said surfacing material, (e) means for applying said second sub-set of surfacing material onto said sheet to form patches thereon, (f) collection means located between said upper flight and said lower flight for collecting and removing said first sub-set of surfacing material and thereby for preventing surfacing material falling from said surfacing material supply means through said opening from falling onto said lower flight, (g) said apparatus including a plurality of said surfacing material supply means, each surfacing material supply means for dropping a different blend of said surfacing material onto said upper flight to form differently colored patches on said sheet, said apparatus further including computer control means responsive to the position of said first belt means for starting the flow of surfacing material from a said surfacing material supply means while an opening in said upper flight is passing therebelow and for stopping the flow of surfacing material from said surfacing material supply means while another opening in said upper flight is passing therebelow.

4. Apparatus for depositing a surfacing material on an asphalt coated sheet, for producing roofing, said apparatus comprising:

(a) means for causing said sheet to travel in a first direction, (b) first belt means having upper and lower flights and having a plurality of openings therein and a plurality of spaces between said openings, (c) means for causing said upper flight of said first belt means to travel above said sheet with a component of movement of said upper flight being in said first direction, (d) surfacing material supply means located above said upper flight for dropping said surfacing material onto said upper flight so that some of said surfacing material falls through said opening and some of said surfacing material remains on said upper flight, the surfacing material falling through said opening being a first sub-set of said surfacing material and said surfacing material remaining on said upper flight being a second sub-set of said surfacing material, (e) means for applying said second sub-set of surfacing material onto said sheet to form patches thereon, at least some of said spaces between said openings being of different length then others of said spaces, for depositing patches of different length on said sheet, (f) collection means located between said upper flight and said lower flight for collecting and removing said first sub-set of surfacing material and thereby for preventing surfacing material falling from said surfacing material supply means through said opening from falling onto said lower flight.

5. Apparatus according to claim 4 wherein said first belt means includes a pair of ends, each end joining said upper and lower flights, and said surfacing material guide means comprises second belt means located adjacent one of said ends for directing said second sub-set of surfacing material from said upper flight onto said sheet.

6. Apparatus according to claim 4 wherein said first belt means includes an end turn for connecting said upper flight to said lower flight, and wherein said surfacing material guide means comprises second belt means located adjacent said end turn and pressing against said end turn to hold said surfacing material on said first belt means until said surfacing material is moving in a substantially downward -direction.

7. Apparatus for depositing a surfacing material on an asphalt coated sheet, for producing roofing, said apparatus comprising:

(a) means for causing said sheet to travel in a first direction, (b) first belt means having upper and lower flights and having an opening therein, (c) means for causing said upper flight of said first belt means to travel above said sheet with a component of movement of said upper flight being in said first direction, (d) surfacing material supply means located above said upper flight for dropping said surfacing material onto said upper flight so that some of said surfacing material falls through said opening and some of said surfacing material remains on said upper flight, the surfacing material falling through said opening being a first sub-set of said surfacing material and said surfacing material remaining on said upper flight being a second sub-set of said surfacing material, (e) means for applying said second sub-set of surfacing material onto said sheet to form patches thereon, (f) collection means located between said upper flight and said lower flight for collecting and removing said first sub-set of surfacing material and thereby for preventing surfacing material falling from said surfacing material supply means through said opening from falling onto said lower flight, (g) said collection means comprising conveyor means.

8. Apparatus according to claim 7 wherein said first belt means contains a plurality of openings therein.

9. Apparatus according to claim 7 wherein said means for applying includes surfacing material guide means cooperating with said first belt means for directing material from said first belt means onto said sheet.

10. Apparatus according to claims 7, 8 or 9 and further including means for applying at least some of said first sub-set of surfacing material collected by said conveyor means onto said sheet.

11. Apparatus according to claim 7 wherein said first belt means travels at a first speed and said sheet travels at a second speed, and including means for producing a fixed relationship between said first and second speeds.

12. Apparatus according to claim 7 wherein said supply means includes means for dropping said surfacing material continuously on said first belt means.

13. Apparatus according to claim 7 and including at least two said surfacing material supply means, each for dropping a different blend of said material on said first belt means to form at least two differently colored sets of patches on said sheet.

* * * * *